US005617635A

United States Patent [19]

Berns

[11] Patent Number: 5,617,635

[45] Date of Patent: Apr. 8, 1997

[54] AUTORETRACTING BOX-CUTTING KNIFE

[75] Inventor: Harald Berns, Wuppertal, Germany

[73] Assignee: Martor-Argentax E.H. Beermann KG, Solingen, Germany

[21] Appl. No.: 579,720

[22] Filed: Dec. 28, 1995

[30] Foreign Application Priority Data

Mar. 3, 1995 [DE] Germany ..... 195 07 272.3

[51] Int. Cl.[6] ..... B26B 1/08

[52] U.S. Cl. ..... 30/162; 30/2

[58] Field of Search ..... 30/2, 162, 317, 30/294

[56] References Cited

U.S. PATENT DOCUMENTS

| | | | |
|---|---|---|---|
| 3,999,290 | 12/1976 | Wood | 30/2 |
| 4,139,939 | 2/1979 | Crooks | 30/2 |
| 4,683,656 | 8/1987 | Peyrot et al. | 30/162 |
| 4,713,885 | 12/1987 | Keklak et al. | 30/162 |
| 4,769,912 | 9/1988 | Davis | 30/162 |
| 4,868,985 | 9/1989 | Rehm | 30/162 |
| 5,303,474 | 4/1994 | Keklak et al. | 30/162 |
| 5,384,963 | 1/1995 | Beermann | 30/162 |

FOREIGN PATENT DOCUMENTS

| | | |
|---|---|---|
| 3744456 | 7/1988 | Germany . |
| 9216337 | 10/1992 | WIPO . |

*Primary Examiner*—Hwei-Siu Payer

*Attorney, Agent, or Firm*—Herbert Dubno; Andrew Wilford

[57] ABSTRACT

An autoretracting box-cutting knife has a housing dimensioned to be held in the hand and having a longitudinally forwardly projecting front end, a blade slide displaceable longitudinally in the housing between a front position and a rear position, and a blade secured in the slide, projecting forward from the housing in the front position of the slide, and retracted back into the housing in the rear position of the slide. In accordance with this invention a blade-actuating crank has an inner and an outer end and is mounted on a pivot on the housing that defines for the crank a transverse pivot axis. Interengaging formations on the crank and holder offset from the pivot can move the crank with the holder between a rear position with its outer end projecting laterally from the housing in the rear position of the holder and a front position in the front position of the holder. A spring engaged between the slide and the housing urges the holder and the crank into the respective rear positions so that when the outer end of the crank is pushed forward to push the crank into the front position the slide is pushed forward into its front position and the blade projects from the housing.

12 Claims, 1 Drawing Sheet

AUTORETRACTING BOX-CUTTING KNIFE

FIELD OF THE INVENTION

The present invention relates to a knife. More particularly this invention concerns an autoretracting box cutter.

BACKGROUND OF THE INVENTION

A standard box-cutting knife such as described in PCT publication WO 92/16337 of P. Hodgson (British priority 22 Mar. 1991) has a housing, a blade holder slidable in the housing, and a blade in the holder displaceable with the holder between a front position projecting from the front end of the housing and a rear position recessed therein. A spring is provided that continuously urges the blade and holder into the rear position and a thumb button is provided that allows the user to push out the blade and hold it out so the knife can be used. When the thumb button is released the blade retracts back into the housing automatically. Such a knife is quite safe, as the blade will retract automatically except when the thumb button is depressed, but is inconvenient as the user must maintain pressure on the thumb button to use the knife.

U.S. Pat. No. 3,999,290 of Wood describes a system where instead of a thumb button a drag element is connected to the holder and projects forward out of the housing. The outer end of this drag element is positioned so that if the front end of the knife is pressed against, for instance, a box to be cut and the knife is pulled backward, the drag element will catch on the box and pull the blade and its holder into the front position, allowing the blade to cut the box. While such a cutter is effective on rough cardboard cartons, the drag element can slip on smoother materials so the blade will not be extended automatically. When the material being cut is very soft, the drag element tears it, making a sloppy cut. It is also possible for the drag element to disengage from the material, allowing the blade to retract so that the user must restart the cut.

Another system is described in German patent 3,744,456 of Rehm. It has a wheel on the front forward edge of the knife that is attached through a gear linkage with the blade holder so that as the wheel is rotated the blade is extended, and when the wheel is maintained in the rotated position the blade stays extended. Such a system only works when the wheel is pressed with quite some lateral force against the object to be cut, which is not always desirable in particular when the object is soft. Furthermore the gear structure is fairly complex so it adds quite a bit to the cost of the tool.

German utility model 1,885,827 describes a double-bladed utility knife with fixedly mounted blades at opposite ends of a handle/housing. Respective guards can be retracted into the handle/housing against the force of a common biasing spring to expose the blades and can be hooked to stay in the retracted position. Such an arrangement is not automatic at all and, even so, is fairly complex.

OBJECTS OF THE INVENTION

It is therefore an object of the present invention to provide an improved autoretracting utility knife.

Another object is the provision of such an improved autoretracting utility knife which overcomes the above-given disadvantages, that is which is of very simple construction but whose blade can be counted on to extend and stay extended when needed and retract when not needed.

SUMMARY OF THE INVENTION

An autoretracting box-cutting knife has according to the invention a housing dimensioned to be held in the hand and having a longitudinally forwardly projecting front end, a blade slide displaceable longitudinally in the housing between a front position and a rear position, and a blade secured in the slide, projecting forward from the housing in the front position of the slide, and retracted back into the housing in the rear position of the slide. In accordance with this invention a blade-actuating crank has an inner and an outer end and is mounted on a pivot on the housing that defines for the crank a transverse pivot axis. Interengaging formations on the crank and holder offset from the pivot can move the crank with the holder between a rear position with its outer end projecting laterally from the housing in the rear position of the holder and a front position in the front position of the holder. A spring engaged between the slide and the housing urges the holder and the crank into the respective rear positions so that when the outer end of the crank is pushed forward to push the crank into the front position the slide is pushed forward into its front position and the blade projects from the housing.

The pivotal action of the crank ensures that the blade will be extended and will stay extended so long as the knife is held against the object being cut. The crank can effect a mechanical advantage so that it engages with only moderate force against the object being cut, while at the same time a relatively stiff spring can be used to retract the blade.

According to the invention the interengaging formations include a pin and a slot in which the pin engages. The pin is normally on the blade holder and the slot is formed in the crank. alternately the crank is provided with a movable slide and the interengaging formations are formed on the holder and slide. The slide can have a pin linking it to a hole in the blade holder or vice versa.

The outer end of the crank is pointed and the holder has one face formed with one of the formations and an opposite face engaging the blade. The housing is formed of a pair of halves one of which has an inwardly projecting pin forming the pivot and the spring is a tension spring.

In accordance with further features of the invention the blade is planar and the crank moves in a plane parallel to the blade plane between its positions. In the rear position the crank projects laterally from the housing. The housing, holder, and crank are made of plastic.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
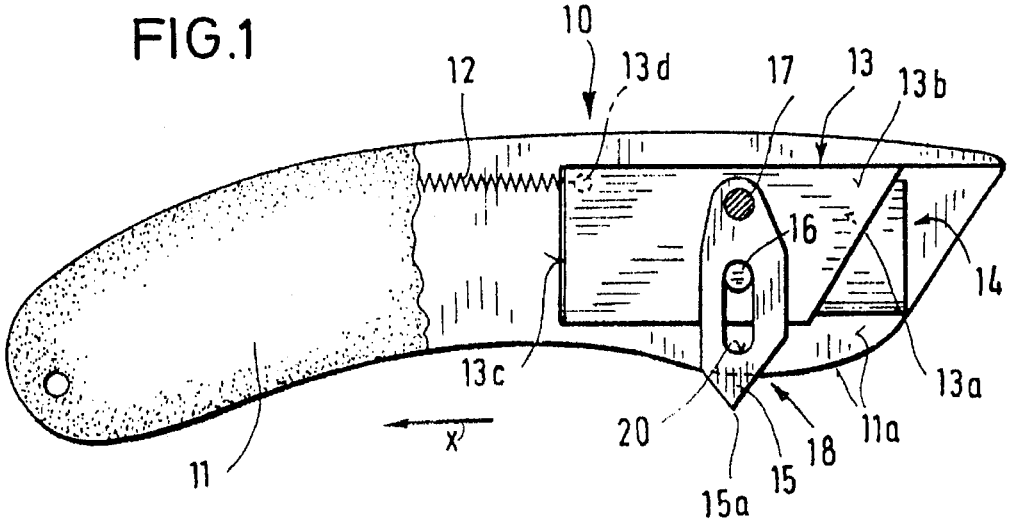
FIG. 1 is a partly sectional side view of the knife according to the invention with the blade retracted.
Figure 2:
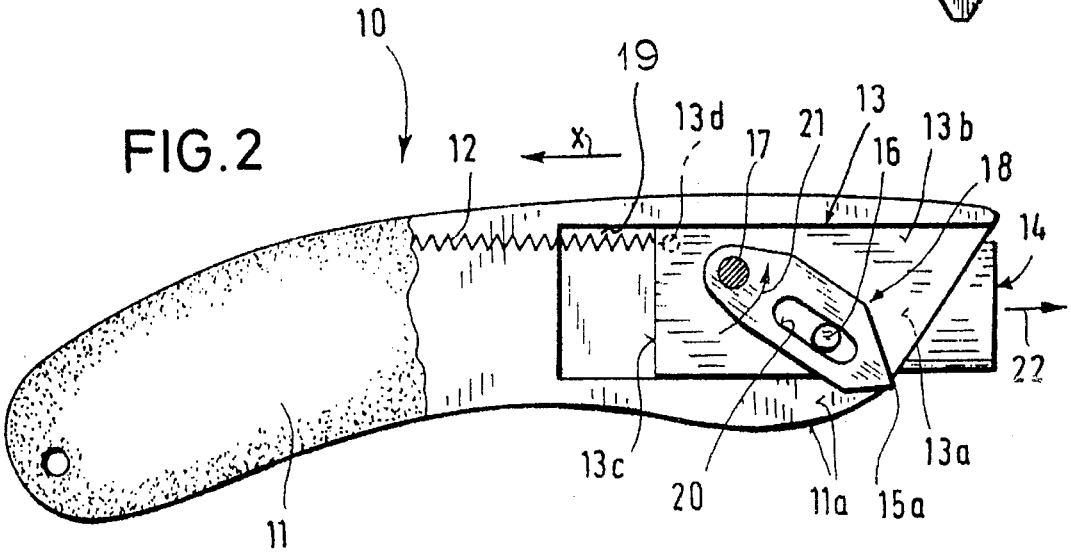
FIG. 2 is a view like FIG. 1 but with the blade extended.

As seen in FIGS. 1 and 2 a utility knife 10 according to the invention basically has an elongated handle or housing 11, typically formed of two screwed-together halves 11*a* (one shown broken away and stippled to the left and the other shown in plan to the right in the drawing), that is moved longitudinally in a direction x along an object to be cut in order to extend a blade 14 in a direction 22 opposite the direction x. The housing 11 can be made of metal or plastic and is curved somewhat so as to be comfortable to hold.

To this end the blade 14 is mounted in a holder 13 displaceable longitudinally in a guide 19 of the housing 11 and having a rear edge 13*c* hooked at an abutment 13*d* to a spring 12 that continuously urges the blade 13 backward in the direction x. The holder 13 is extended by a mechanism here constituted as an arm 18 having an inner end pivoted on a pin 17 fixed to the housing 11 and an outer end 15 forming a point 15*a*. In FIGS. 1 and 2 a pin 16 projecting from a face 13*b* of the holder 13, opposite the face 13*a* to which the blade 14 is secured, engages in a radially elongated slot 20 of the arm 18.

Thus under normal circumstances the spring 12 will hold the blade holder and its blade 14 in the illustrated retracted position, in which the point 15*a* extends laterally from the housing 11, perpendicular to the longitudinal direction x and 22.

To use the knife the point 15*a* is pressed transversely of the handle/housing 11 against the object to be cut, and the knife 10 is pulled back in the direction x. This causes the arm 18 to pivot forward as shown by arrow 21 and force the holder 13 out of the housing into the FIG. 2 position.

Figure 3:
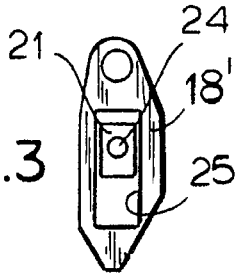
FIG. 3 is a detail view of a variant on an element of the knife.

FIG. 3 shows how an arm 18 can be formed with a guide 25 in which can move a slide 21 having a pin 24 that engages in a recess of the holder 13. Alternately the slide 21 could have a hole and the holder 13 a pin like the pin 16 of FIGS. 1 and 2.

I claim:

1. An autoretracting box-cutting knife comprising:

a housing dimensioned to be held in a hand of a user and having a longitudinally forwardly projecting front end;

a holder slidable longitudinally in the housing between a front position and a rear position;

a blade secured in the holder, projecting forward from the housing in the front position of the holder, and retracted back into the housing in the rear position of the holder;

a blade-actuating crank having an inner end and an outer end;

a pivot on the housing connected to the crank inner end and defining for the crank a transverse pivot axis;

means on the crank and the holder including a pin and a slot in which the pin engages offset from the pivot for moving the crank with the holder between a rear position with the crank outer end projecting laterally from the housing in the rear position of the holder and a front position in the front position of the holder; and a spring engaged between the holder and the housing urging the holder and the crank into the respective rear positions, whereby when the outer end of the crank is pushed forward to push the crank into the front position the holder is pushed forward into the front position and the blade projects from the housing.

2. The autoretracting box-cutting knife defined in claim 1 wherein the outer end of the crank is pointed.

3. The autoretracting box-cutting knife defined in claim 1 wherein the holder has one face formed with one of the pin and the slot and an opposite face engaging the blade.

4. The autoretracting box-cutting knife defined in claim 1 wherein the spring is a tension spring.

5. The autoretracting box-cutting knife defined in claim 1 wherein the blade is planar and the crank moves in a plane parallel to the blade plane.

6. The autoretracting box-cutting knife defined in claim 1 wherein in the rear position the crank projects laterally from the housing.

7. The autoretracting box-cutting knife defined in claim 1 wherein the housing, the holder, and the crank are made of plastic.

8. An autoretracting box-cutting knife comprising:

a housing dimensioned to be held in a hand of a user and having a longitudinally forwardly projecting front end;

a holder slidable longitudinally in the housing between a front position and a rear position;

a blade secured in the holder, projecting forward from the housing in the front position of the holder, and retracted back into the housing in the rear position of the holder;

a blade-actuating crank having an inner end and an outer end and provided with a movable slide;

a pivot on the housing connected to the crank inner end and defining for the crank a transverse pivot axis;

means including interengaging formations formed on the holder and the slide offset from the pivot for moving the crank with the holder between a rear position with the crank outer end projecting laterally from the housing in the rear position of the holder and a front position in the front position of the holder; and;

a spring engaged between the holder and the housing urging the holder and the crank into the respective rear positions, whereby when the outer end of the crank is pushed forward to push the crank into the front position the holder is pushed forward into the front position and the blade projects from the housing.

9. The autoretracting box-cutting knife defined in claim 8 wherein the interengaging formations include a pin and a slot in which the pin engages.

10. The autoretracting box-cutting knife defined in claim 9 wherein the pin is on the holder and the slot is formed in the crank.

11. The autoretracting box-cutting knife defined in claim 8 wherein the interengaging formations include a pin and a recess in which the pin is engaged.

12. An autoretracting box-cutting knife comprising:

a housing formed of a pair of halves one of which has an inwardly projecting pin, dimensioned to be held in a hand of a user, and having a longitudinally forwardly projecting front end;

a holder slidable longitudinally in the housing between a front position and a rear position;

a blade secured in the holder, projecting forward from the housing in the front position of the holder, and retracted back into the housing in the rear position of the holder;

a blade-actuating crank having an inner end and an outer end;

a pivot formed by the pin, connected to the crank inner end, and defining for the crank a transverse pivot axis;

means including interengaging formations on the crank and the holder offset from the pivot for moving the crank with the holder between a rear position with the crank outer end projecting laterally from the housing in the rear position of the holder and a front position in the front position of the holder; and a spring engaged between the holder and the housing urging the holder and the crank into the respective rear positions, whereby when the outer end of the crank is pushed forward to push the crank into the front position the holder is pushed forward into the front position and the blade projects from the housing.

* * * * *